United States Patent [19]

Baran, Jr. et al.

[11] Patent Number: 4,648,792

[45] Date of Patent: Mar. 10, 1987

[54] STATOR VANE SUPPORT ASSEMBLY

[75] Inventors: Walter J. Baran, Jr., S. Glastonbury; Gary F. Chaplin, Vernon; Vincent P. Laurello, Guilford, all of Conn.

[73] Assignee: United Technologies Corporation, Hartford, Conn.

[21] Appl. No.: 728,951

[22] Filed: Apr. 30, 1985

[51] Int. Cl.[4] ..... F01D 25/28

[52] U.S. Cl. ..... 415/139; 415/170 R; 415/218; 415/199.5

[58] Field of Search ..... 415/115, 116, 136–139, 415/170 R, 175, 178, 189, 199.5, 190, 191, 216–218; 60/226.1, 39.75, 39.83

[56] References Cited

U.S. PATENT DOCUMENTS

| | | | |
|---|---|---|---|
| 2,851,246 | 9/1958 | Nichols | 415/190 X |
| 2,982,519 | 5/1961 | Haworth et al. | 415/217 |
| 3,807,891 | 4/1974 | McDow et al. | 415/138 X |
| 4,363,599 | 12/1982 | Cline et al. | 415/178 X |
| 4,391,565 | 7/1983 | Speak | 415/190 X |
| 4,553,901 | 11/1985 | Laurello | 415/139 X |

*Primary Examiner*—Edward K. Look
*Assistant Examiner*—Joseph M. Pitko
*Attorney, Agent, or Firm*—Stephen E. Revis

[57] ABSTRACT

A stage of circumferentially disposed turbine stator vane clusters and arcuate, circumferentially disposed segments of a rotor outer air seal disposed on one side of the stator stage is secured to an annular attachment ring which is integral with a surrounding turbine case. The outer seal segments are trapped axially between stator vane clusters and the radially inner ends of arcuate support segments, and are also radially supported thereby. The radially inner ends of the support segments are trapped axially between the stator vane clusters and the annular attachment ring, and are also supported radially thereby. This boltless attachment reduces the number of parts while providing strong radially support and accurate radial location for the seal segments.

2 Claims, 1 Drawing Figure

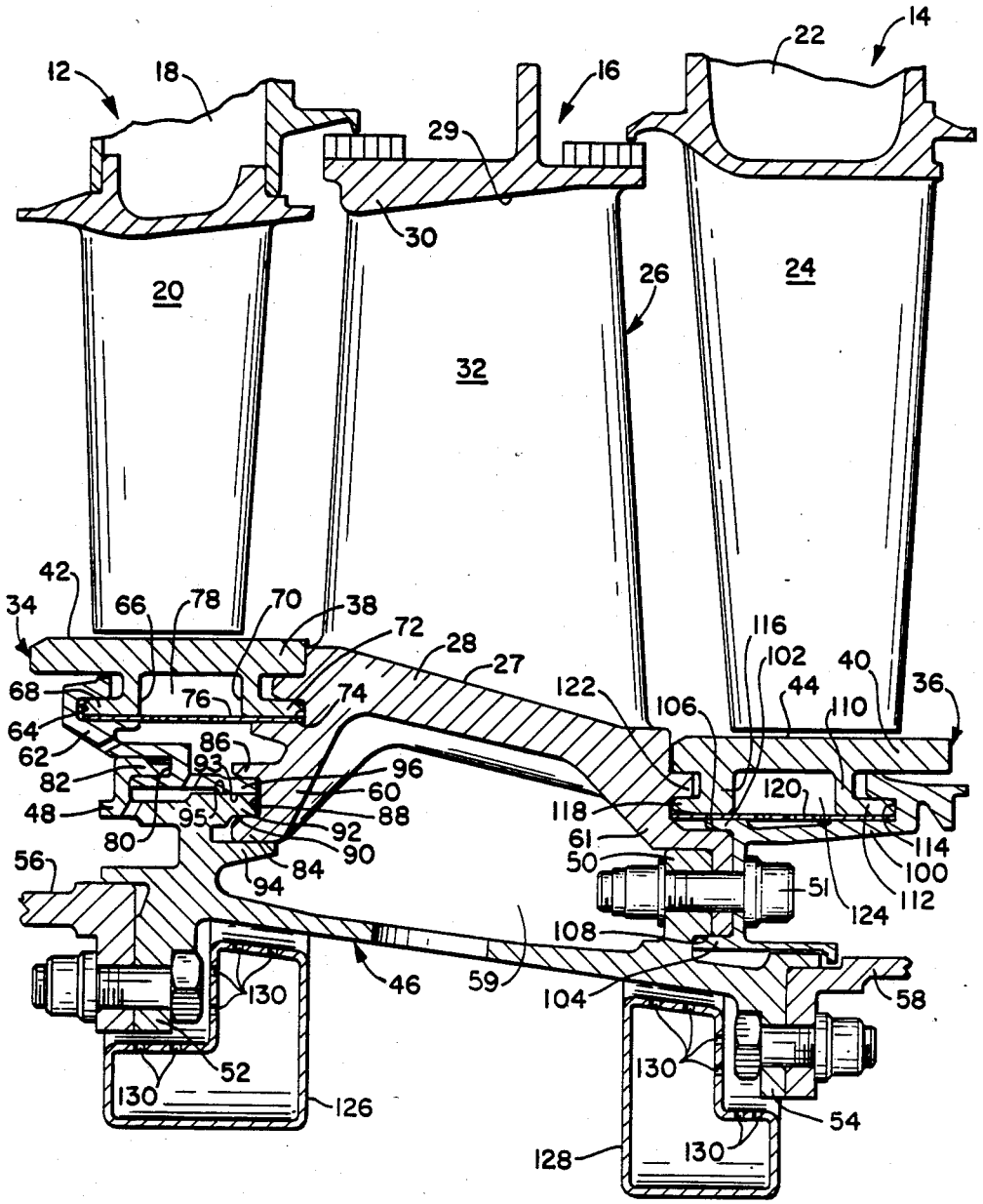
12
18
16
14
22
29
30
20
26
24
32
42
34
66
78
70
38
72
28
27
116
102
40
36
68
76
74
122
106
44
110
64
62
86
93
96
82
60
120
48
95
88
118
61
114
80
92
90
50
100
56
84
94
51
112
124
108
46
59
104
58
130
52
130
126
130
54
128
130

STATOR VANE SUPPORT ASSEMBLY

TECHNICAL FIELD

This invention relates to gas turbine engines, and more particularly to structure for supporting rotor outer air seals.

BACKGROUND ART

In a gas turbine engine a stage of stator vanes is disposed between rotor stages, such as in a turbine section having at least two rotating stages. Segmented outer air seals surround the rotating stages and define portions of the gas flow path. It is desirable that the blade tips be spaced as close as possible to the outer air seals to minimize leakage of gases around the tips of the blades. As a result of thermal growth and centrifugal forces the radial location of the blade tips varies during engine operation. It is, therefore, common to support the air seal segments and to control the temperature of the structure supporting the segments in a manner adapted to have them move radially simultaneously with and in the same direction as the blade tips in order to maintain as small a gap therebetween throughout various engine operating modes.

Commonly owned U.S. Pat. No. 3,990,807 shows outer air seals radially supported entirely by structure attached to the radially outer ends of axially adjacent stator vanes. The outer ends of the vanes supporting the seal segments are free to move radially relative to an outer casing. The outer air seal segments thereby move in concert with the outer ends of the stator vanes to which they are attached. Stator vane growth is assumed to match rotor blade growth such that a small clearance is maintained between the blades and the outer air seals. One object of that invention is to provide for support and growth of the outer diameter of the stator vanes independent of a surrounding annular turbine casing.

In commonly owned U.S. Pat. No. 3,992,126, each outer air seal segment of a first rotor stage has its front and rear end radially supported and located from respective front and rear annular support rings attached to a surrounding turbine casing. Outer seal segments for the following rotor stage are similarly secured to another pair of axially spaced apart support rings which are fixed to the turbine casing. The front and rear feet of stator vanes disposed between the adjacent rotor stages are secured to the two centrally located rings of the above mentioned four support rings. Other patents showing segmented outer air seals secured at their forward and rearward ends to respective forward and rearward annular support rings fixed to an outer turbine casing are commonly owned U.S. Pat. Nos. 3,957,391 and 3,975,112.

Commonly owned U.S. Pat. Nos. 4,019,320 and 4,069,662 also show segmented outer air seals for successive turbine stages secured to separate pairs of axially spaced apart rings or flanges which are in turn secured to or integral with a surrounding casing. In those patents the clearance between the outer air seals and the blade tips is controlled by directing cooling air against the casing, whereby the outer air seal segments move radially in concert with the casing. Controlling the growth of the casing thereby controls movement of the air seals. In the embodiment shown therein cooling air is directed from five circumferentially mounted, axially spaced apart spray bars, against four axially spaced apart casing flanges or flange joints for the purpose of controlling the radial movement of only two stages of outer air seals.

DISCLOSURE OF INVENTION

One object of the present invention is a simplified scheme for attaching a stage of stator vanes and adjacent rotor outer air seal segments to a surrounding casing.

A further object of the present invention is a vane and outer air seal assembly having fewer parts and less weight.

Another object of the present invention is a vane and outer air seal assembly, the radial growth of which may be controlled externally of the case.

In accordance with the present invention, a plurality of stator vane units are circumferentially disposed about an engine axis to define a stage of stator vanes, the assembly also including a circumferentially segmented annular outer air seal for a rotor stage adjacent the vane stage, wherein annular support means extends radially outwardly from each of the seal segments and from each vane unit and connects said segments and vane units to a radially inwardly extending annular attachment ring of a surrounding annular case in a manner which fixes the radial location of the seal segments and the vane units relative to the attachment ring.

In a preferred embodiment the assembly is in the turbine section of a gas turbine engine and has a segmented annular outer air seal immediately upstream of the vane stage and immediately downstream of the vane stage. An outer turbine case includes a radially inwardly extending front attachment ring and a radially inwardly extending rear attachment ring. The front seal segments and the front or upstream ends of the vane units are all connected to the front attachment ring and are fixed radially relative thereto. The rear end of each outer air seal segment engages the front end of a vane unit outer wall and is supported radially therefrom. The front end of each seal segment sealingly engages the radially inner end of seal support segments and is located radially thereby. The radially outer end of each support segment has a forwardly facing groove which receives a rearwardly facing cylindrical projection of the front attachment ring. A rearwardly extending arcuate projection on the outer end of each support segment tightly engages a forwardly facing arcuate groove in the front, radially outwardly extending feet of the vane units.

The support segments are thus trapped axially between the attachment ring and the vane feet; and the seal segments are trapped axially between the support segments and the vane units. There are no bolts holding the seal segments or support segments in place. The vane units are fixed axially relative to the case at a location axially rearward of the attachment ring, such as by securing rear vane feet to the case by bolts.

The foregoing and other objects, features and advantages of the present invention will become more apparent in the light of the following detailed description of preferred embodiments thereof as shown in the accompanying drawing.

BRIEF DESCRIPTION OF THE DRAWING

The sole FIGURE is a sectional view of a portion of the turbine section of a gas turbine engine incorporating the features of the present invention.

BEST MODE FOR CARRYING OUT THE INVENTION

As an exemplary embodiment of the present invention, consider the portion of a turbine section of a gas turbine engine shown in the FIGURE. The turbine section comprises a first rotor stage 12, a second rotor stage 14, and a stator stage 16 disposed between the rotor stages. Gas flow is from left to right.

The rotor stage 12 comprises a disk 18 having a plurality of circumferentially disposed blades 20 extending radially outwardly therefrom. Similarly, the rotor stage 14 includes a disk 22 having a plurality of rotor blades 24 extending radially outwardly therefrom. The stator stage 16 is comprised of a plurality of vane units 26, circumferentially disposed about the engine axis, which is coincident with the axes of the rotor stages 12, 14. Each unit 26 includes an arcuate outer wall 28 having a radially inwardly facing surface 27, and an arcuate inner wall 30 having a radially inwardly facing surface 29. The outer walls 28 are disposed in circumferentially abutting relationship, and the surfaces 27 define the outer boundary of a portion of the gas flow path of the engine. The inner walls 30 are disposed in circumferentially abutting relationship, and the surfaces 29 define the inner boundary of a portion of the gas flow path. Each vane unit 26 includes at least one airfoil 32 extending from the outer wall 28 to the inner wall 30 of the unit 26. In this embodiment each unit 26 includes two airfoils 32 integral with both the inner and outer walls. A vane unit 26 which includes more than one airfoil is hereinafter referred to as a "vane cluster" 26.

A first annular, circumferentially segmented outer air seal 34 surrounds the first rotor stage 12, and a second annular, circumferentially segmented outer air seal 36 surrounds the second rotor stage 14. The first and second air seals 34, 36 each comprise a plurality of circumferentially disposed abutting arcuate segments 38, 40, respectively. Radially inwardly facing surfaces 42, 44 of the segments 38, 40, respectively, define portions of the outer boundary of the engine gas flow path.

A one piece annular turbine case 46 surrounds both rotor stages and the stator stage. The case 46 includes an annular, radially inwardly extending front attachment ring 48 and an annular, radially inwardly extending rear attachment ring 50 spaced axially therefrom. The case 46 also includes an annular, radially outwardly extending front flange 52 and an annular, radially outwardly extending rear flange 54 spaced axially from the front flange. The front flange 52 is bolted to a forward case 56 (partially shown), and the rear flange 54 is bolted to a rear case 58 (partially shown). For reasons which will hereinafter be explained, the front attachment ring 48 and the front flange 52 are in axial proximity, as are the rear attachment ring 50 and the rear flange 54. Also, in accordance with the present embodiment, the flange 52 is substantially axially aligned with the segments 38; and the flange 54 is substantially axially aligned with the segments 40 to improve containment in the event of loss of one or more blades 20, 24.

In accordance with the teachings of the present invention, the first outer air seal segments 38, the vane clusters 26, and the second outer air seal segments 40 are all radially supported from and fixed radially relative to the front and rear attachment rings 48, 50 by means of support structure hereinafter described. The upstream end of each vane cluster 26 is supported radially from the front attachment ring 48 by a front foot 60 which is integral with the upstream end of the outer wall 28. The downstream end of each vane cluster 26 is supported radially from the rear attachment ring 50 by a rear foot 61 which is integral with the downstream end of the outer wall 28 and secured to the ring 50 by bolts 51. The feet 60 of all the clusters 26 together form a full annular ring concentric with the engine axis; and the feet 61 similarly form a full annular ring. An annular cooling air compartment 59 is defined by the case 46, the feet 60, 61 and the outer wall 28.

The upstream ends of the first outer air seal segments 38 are supported from the front attachment ring 48 through a plurality of arcuate, circumferentially disposed, abutting front support segments 62, which together form a full annular member concentric with the engine axis. The radially innermost end of such member has a rearwardly facing, annular groove 64. Proximate the front end of each segment 38, and integral therewith and extending radially outwardly therefrom is a front leg 66 having an arcuate projection 68 extending forwardly into the groove 64 and overlying the interface between two circumferentially adjacent front support segments 62.

Each segment 38 also includes a radially outwardly extending rear leg 70 integral therewith and having a rearwardly extending arcuate projection 72 which extends into a forwardly facing arcuate groove 74 in each the upstream end of the outerwall 28 of each of a pair of adjacent vane clusters 26. An annular seal plate 76 is disposed radially outwardly of and in contact with the projections 68, 72 and extends axially from within the grooves 64 of the support segments 62 to within the grooves 74 of the vane cluster feet 60 to define an annular cooling air compartment 78 between the legs 66, 70. The plate 76 and projections 68, 72 fit relatively tightly within respective grooves 64, 74 to create annular seals.

The radially outer end of each segment 62 includes an arcuate forwardly facing groove 80. The grooves 80 of the segments 62 together define an annulus concentric with the engine axis. A rearwardly extending cylindrical projection 82 on the radially innermost end of the front attachment ring 48 fits tightly within grooves 80, forming a seal and fixing the radial position of the segments 62 relative to the ring 48. Each front foot 60 of the vane clusters 26 includes a forwardly extending outer lip 84 and forwardly extending inner lip 86 which are spaced apart to define, in combination with the other clusters 26, a forwardly facing annular groove 88. The outer lips 84 extend into and sealingly engage a rearwardly facing annular groove 90 in the front attachment ring 48 formed between inner and outer radially spaced apart cylindrical projections 92, 94, respectively, of the ring 48. Rearwardly extending arcuate projections 96 at the radially outermost end of each front support segment 62 each have outer surfaces 93 which mate with an outer cylindrical surface 95 of the projection 92. The mating projections 96, 92 are disposed tightly within and sealingly engage the rearwardly facing annular groove 88 of the vane clusters 26, and help radially locate the vane feet 60 relative to the ring 48.

From the foregoing description, it is apparent the front ends of the segments 38 are located and fixed radially relative to the front attachment ring 48 through the front support segments 62; and the rear ends of the segments 38 are located and fixed radially relative to the front attachment ring 48 through the vane cluster front feet 60. Also, the segments 38, being trapped between the support segments 62 and feet 60, are located axially relative to the case 46, although dimensions are selected to intentionally allow limited axial movement.

Second outer air seal segments 40 are supported radially and fixed relative to the rear attachment ring 50 through vane cluster rear feet 61 and arcuate rear support segments 100. The rear support segments 100 are circumferentially disposed about the engine axis and abut each other to define a full annular ring. Each segment 100 is fixedly secured to the rear attachment ring 50 by means of the bolts 51. Radially spaced apart, forwardly extending inner and outer arcuate projections 102, 104 tightly engage, respectively, the radially inwardly facing arcuate surface 106 of a pair of circumferentially adjacent feet 61 and the radially outwardly facing annular surface 108 of the attachment ring 50 to fix the radial location of the supports 100 relative to the ring 50.

Proximate the rear end of each air seal segment 40, and integral therewith and extending radially outwardly therefrom is a rear leg 110 having an arcuate projection 112 extending rearwardly into an annular groove 114 formed by the rear support segments 100. In this embodiment each leg 112 overlies the interface between two circumferentially adjacent segments 100. Each segment 100 also includes a radially outwardly extending front leg 116 integral therewith and having a forwardly extending arcuate projection 118. An annular seal plate 120 surrounds the segments 40 and is in contact, at its respective rearward and forward ends, with the projections 112, 118, respectively. The annular plate 120 and the outer air seal segments 40 define an annular compartment 124. The rearward end of the plate 120 and the projection 112 fit tightly within the annular groove 114. The front end of the plate 120 is sandwiched between the projections 102 of the support segments 100 and the projections 118 of the air seal segment front legs 116. A radially inwardly facing arcuate surface of each leg 118 bears against the radially outwardly facing surfaces of rearwardly extending arcuate projections 122 of the vane cluster outer wall 28. The front ends of the outer air seal segments 40 are thus located and fixed radially relative to the rear attachment ring 50.

Annular cooling air spray bars 126, 128 are disposed, respectively, adjacent the front flange 52 and rear flange 54 of the case 46 for directing cooling air, through a plurality of holes 130, against the flanges 52, 54 and against those portions of the case 46 which are substantially axially aligned with the front and rear attachment rings 48, 50. As a result of this arrangement, the radial growth of both the front and rear ends of the case 46, and therefore of both the first and second outer air seals 34, 36, may be controlled in the manner of hereinabove referred to commonly owned U.S. Pat. Nos. 4,019,320 and 4,069,662, which are incorporated herein by reference. In this manner the radial gaps between the rotor blades 20, 24 and their respective outer air seals 34, 36 are kept to a minimum throughout engine operation.

Although the invention has been shown and described with respect to a preferred embodiment thereof, it should be understood by those skilled in the art that other various changes and omissions in the form and detail thereof may be made therein without departing from the spirit and the scope of the invention.

We claim:

1. A vane and outer air seal assembly for a gas turbine engine comprising:

a one piece annular case having an axis and a radially inwardly extending annular attachment ring, said ring having a rearwardly extending first cylindrical projection and a rearwardly extending second cylindrical projection spaced rearwardly of said first projection, said second projection having a radially inwardly facing cylindrical surface;

a plurality of stator vane units disposed circumferentially about said axis radially inwardly of said case, each unit comprising an arcuate outer wall, said outer walls being in circumferentially abutting relationship defining a radially inwardly facing portion of a gas flow path, each wall having at least one airfoil extending radially inwardly therefrom, each outer wall having a front end, a front foot integral with and extending radially outwardly from said front end, and a rear foot integral with and extending radially outwardly from said rear end, each of said front feet comprising a forwardly facing first arcuate groove, said first grooves defining a first annular groove, said assembly including means for fixing each of said rear feet to said case for preventing axial movement of said stator vane units relative to said case;

annular outer air seal means comprising a plurality of adjacent, circumferentially disposed, arcuate, axially extending seal segments defining a radially inwardly facing portion of a gas flow path, each segment having a front end and a rear end, said rear end of each segment sealingly engaging and radially supported and located by said front end of said outer wall of at least one of said vane units; and support means interconnecting said front end of each seal segment and said attachment ring, said support means including a plurality of arcuate, circumferentially disposed support segments defining an annular wall, each support segment having a radially inner end engaging said front end of at least one of said seal segments for fixing the radial position of said seal segment front end relative to said support segment, each support segment having a radially outer end, said outer end including an arcuate, forwardly facing groove, said forwardly facing grooves of said support segments defining a second annular groove, each support segment outer end also including a rearwardly extending arcuate projection spaced rearwardly of said second annular groove and having a radially outwardly facing surface in mating contact with said inwardly facing cylindrical surface of said second cylindrical projection of said attachment ring;

said second cylindrical projection and said rearwardly extending arcuate projection being tightly disposed within said first annular groove for radially locating said vane unit feet relative to said attachment ring; and said first cylindrical projection being tightly disposed within said second annular groove for fixing said support segments radially relative to said attachment ring.

2. The assembly according to claim 1, wherein said case includes a radially outwardly extending annular flange axially located proximate said attachment ring, said assembly including an annular spray bar adjacent said annular flange for directing cooling fluid on said flange to control the thermal radial growth of said attachment ring and thereby the radial location of said outer air seal segments.

* * * * *